US007520207B1

(12) United States Patent
Fuqua et al.

(10) Patent No.: US 7,520,207 B1
(45) Date of Patent: Apr. 21, 2009

(54) MODULAR BALLISTIC WALL ASSEMBLY

(75) Inventors: Charles Louis Fuqua, Woodbridge, VA (US); Steven Scott Kahre, Spotsylvania, VA (US)

(73) Assignee: Patriot3, Inc., Fredericksburg, VA (US)

( * ) Notice: Subject to any disclaimer, the term of this patent is extended or adjusted under 35 U.S.C. 154(b) by 177 days.

(21) Appl. No.: 11/590,222

(22) Filed: Oct. 31, 2006

Related U.S. Application Data

(60) Provisional application No. 60/737,798, filed on Nov. 18, 2005.

(51) Int. Cl.
*F41H 5/06* (2006.01)
*F41H 5/08* (2006.01)

(52) U.S. Cl. ..... 89/36.07; 89/36.02; 109/82

(58) Field of Classification Search ..... 89/36.01, 89/36.02, 36.04, 36.05, 36.07; 109/78, 79, 109/80, 82, 84, 85
See application file for complete search history.

(56) References Cited

U.S. PATENT DOCUMENTS

| | | | | | |
|---|---|---|---|---|---|
| 1,304,541 | A * | 5/1919 | Clark | 89/36.09 |
| 4,245,546 | A * | 1/1981 | Chaires | 89/36.09 |
| 4,727,789 | A * | 3/1988 | Katsanis et al. | 86/50 |
| 4,781,101 | A * | 11/1988 | Zevuluni et al. | 89/36.09 |
| 4,896,613 | A * | 1/1990 | Salzer | 109/27 |
| 4,928,468 | A * | 5/1990 | Phillips | 52/574 |
| 5,142,997 | A | 9/1992 | DeLong et al. | |
| 6,401,427 | B1 | 6/2002 | Snyder | |
| 6,438,906 | B1 * | 8/2002 | Komarowski et al. | 52/169.1 |
| 6,532,857 | B1 * | 3/2003 | Shih et al. | 89/36.02 |
| 6,622,607 | B1 * | 9/2003 | Miller | 89/36.07 |
| 6,672,195 | B1 * | 1/2004 | Plattner | 89/36.11 |
| 6,818,268 | B2 * | 11/2004 | Gonzalez | 428/34 |
| 6,907,811 | B2 | 6/2005 | White | |
| 2003/0129025 | A1 | 7/2003 | Donovan | |
| 2004/0020354 | A1 | 2/2004 | Ravid et al. | |
| 2005/0022658 | A1 | 2/2005 | Bateman et al. | |
| 2005/0235819 | A1 * | 10/2005 | Long | 89/36.07 |
| 2007/0012168 | A1 * | 1/2007 | Weatherwax | 89/36.04 |
| 2007/0028759 | A1 * | 2/2007 | Williams | 89/36.09 |
| 2008/0092730 | A1 * | 4/2008 | Hall | 89/36.04 |

* cited by examiner

*Primary Examiner*—Bret Hayes
(74) *Attorney, Agent, or Firm*—Schwartz Law Firm, P.C.

(57) ABSTRACT

A modular ballistic wall assembly incorporates a rigid frame including first and second spaced-apart uprights, and at least one cross-member extending between the uprights. A plurality of ballistic panels are carried by the frame between the first and second uprights. Each ballistic panel has top and bottom edges, opposing side edges, and opposing major surfaces. The major surfaces define respective threat and lee sides of the panel. The ballistic panels are arranged edge-to-edge, such that adjacent panels form an unprotected seam therebetween. A first ballistic seam protector is carried by the cross-member of the frame, and covers the unprotected seam on the threat-side of the ballistic panels. A second ballistic seam protector is carried by one of the first and second uprights of the frame on the threat-side of the ballistic panels. The second ballistic seam protector is adapted for covering a second unprotected seam formed between adjacent ballistic panels.

21 Claims, 10 Drawing Sheets

MODULAR BALLISTIC WALL ASSEMBLY

TECHNICAL FIELD AND BACKGROUND OF THE INVENTION

This invention relates generally to a modular ballistic wall assembly which is bullet, blast and attack resistant. The invention provides a security barrier for protecting personnel, equipment, and other valuable structure. The invention has a unique modular design applicable for promoting fast and convenient field assembly into virtually any desired configuration.

Ballistic barriers are often employed for personnel protection and tactical advantage by law enforcement, military, security, and other personnel. Such ballistic barriers may be erected or otherwise transported into a desired position to create a physically protective barrier between law enforcement and adversaries. Ballistic walls typically provide additional protection against ballistic projectiles (e.g., bullets fired from a gun). Unfortunately, known ballistic barriers are difficult to transport and fail to provide for adaptable configurability to different environments. Additionally, these such barriers often have non-ballistic elements or seams which may compromise the overall ballistic performance of the structure.

SUMMARY OF THE INVENTION

Therefore, it is an object of the invention to provide a modular ballistic wall assembly which is readily configurable and re-configurable in the field.

It is another object of the invention to provide a modular ballistic wall assembly which offers improved ballistic protection against multiple threats in any given environment.

It is another object of the invention to provide a modular ballistic wall assembly which provides a convenient, modular security barrier for protecting personnel, equipment, and other valuable structure.

It is another object of the invention to provide a modular ballistic wall assembly which is easily transported and quickly assembled.

It is another object of the invention to provide a modular ballistic wall assembly which is bullet, blast and attack resistant.

It is another object of the invention to provide a modular ballistic wall assembly which offers substantially uninterrupted threat-side ballistic protection.

It is another object of the invention to provide a modular ballistic wall assembly which has an aesthetically inconspicuous appearance.

It is another object of the invention to provide a modular ballistic wall assembly which may have an aesthetically pleasing appearance.

It is another object of the invention to provide a method for assembling a ballistic barrier.

It is another object of the invention to provide a method for protecting personnel, equipment, and other valuable structure.

These and other objects of the present invention are achieved in the preferred embodiments disclosed below by providing a modular ballistic wall assembly. The wall assembly comprises a rigid frame including first and second spaced-apart uprights, and at least one cross-member extending between the uprights. A plurality of ballistic panels are carried by the frame between the first and second uprights. Each ballistic panel has top and bottom edges, opposing side edges, and opposing major surfaces. The major surfaces define respective threat and lee sides of the panel. The ballistic panels are arranged edge-to-edge, such that adjacent panels form an unprotected seam therebetween. A first ballistic seam protector is carried by the cross-member of the frame, and covers the unprotected seam on the threat-side of the ballistic panels. A second ballistic seam protector is carried by one of the first and second uprights of the frame on the threat-side of the ballistic panels. The second ballistic seam protector is adapted for covering a second unprotected seam formed between adjacent ballistic panels.

The term "ballistic" means capable of absorbing or resisting the impact of a projectile, such as a bullet. The ballistic elements described herein are intended to stop, or at least severely retard, the progress of projectiles; though they may not be completely impenetrable to all types of projectiles under all situations.

According to one preferred embodiment of the invention, the first seam protector includes an edge-to-edge assembly of hard armor tiles.

According to another preferred embodiment of the invention, the first seam protector further includes a second edge-to-edge assembly of hard armor tiles residing in back of the first tile assembly.

Preferably, the first and second tile assemblies are offset, such that seams formed between adjacent tiles of the first assembly are offset from seams formed between adjacent tiles of the second assembly.

According to another preferred embodiment of the invention, the second seam protector includes an edge-to-edge assembly of hard armor tiles.

According to yet another preferred embodiment of the invention, the second seam protector further includes a second edge-to-edge assembly of hard armor tiles residing in back of the first tile assembly.

Preferably, the first and second tile assemblies are offset, such that seams formed between adjacent tiles of the first assembly are offset from seams formed between adjacent tiles of the second assembly.

Preferably, the hard armor tiles of the first and second seam protectors are constructed of a material selected from a group consisting of ceramic, steel, graphite, aluminum, and titanium. Alternatively, the seam protectors may be formed of polyethylene fiber composite panels or aramid fiber composite panels for lesser threats, such as NIJ3A. These such materials may be used as continuous seam protection panels, extending continuously from one end of the frame element (e.g., cross member and upright) to the other.

Preferably, the first and second seam protectors further comprise an aesthetic outside cover.

According to another preferred embodiment of the invention, a base is attached to the rigid frame to support the frame in a substantially upright condition.

According to yet another preferred embodiment of the invention, each ballistic panel is substantially planar, and has substantially straight top, bottom, and side edges. Although the ballistic panels are shown as being substantially square in shape, other shapes are possible (e.g., triangular, trapezoidal, hexagonal, irregularly shaped).

Preferably, at least one of the first and second uprights has a generally H-shaped cross-section which defines first and second longitudinal panel channels adapted for receiving respective edges of adjacent ballistic panels.

According to another preferred embodiment of the invention, the first and second uprights have respective longitudinal fastener tracks for securing the cross-member and first ballistic seam protector at the unprotected seam between the adjacent ballistic panels.

Preferably, the cross-member has a generally H-shaped cross-section which defines first and second lateral panel channels adapted for receiving respective edges of adjacent ballistic panels.

According to another preferred embodiment of the invention, a third ballistic seam protector carried the other upright of the frame on the threat-side of the ballistic panels. This seam protector is adapted for covering a third unprotected seam formed between adjacent ballistic panels.

The term "modular" is used broadly herein in reference to various standardized elements of the present invention.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

The present invention is described more fully hereinafter with reference to the accompanying drawings, in which one or more preferred embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
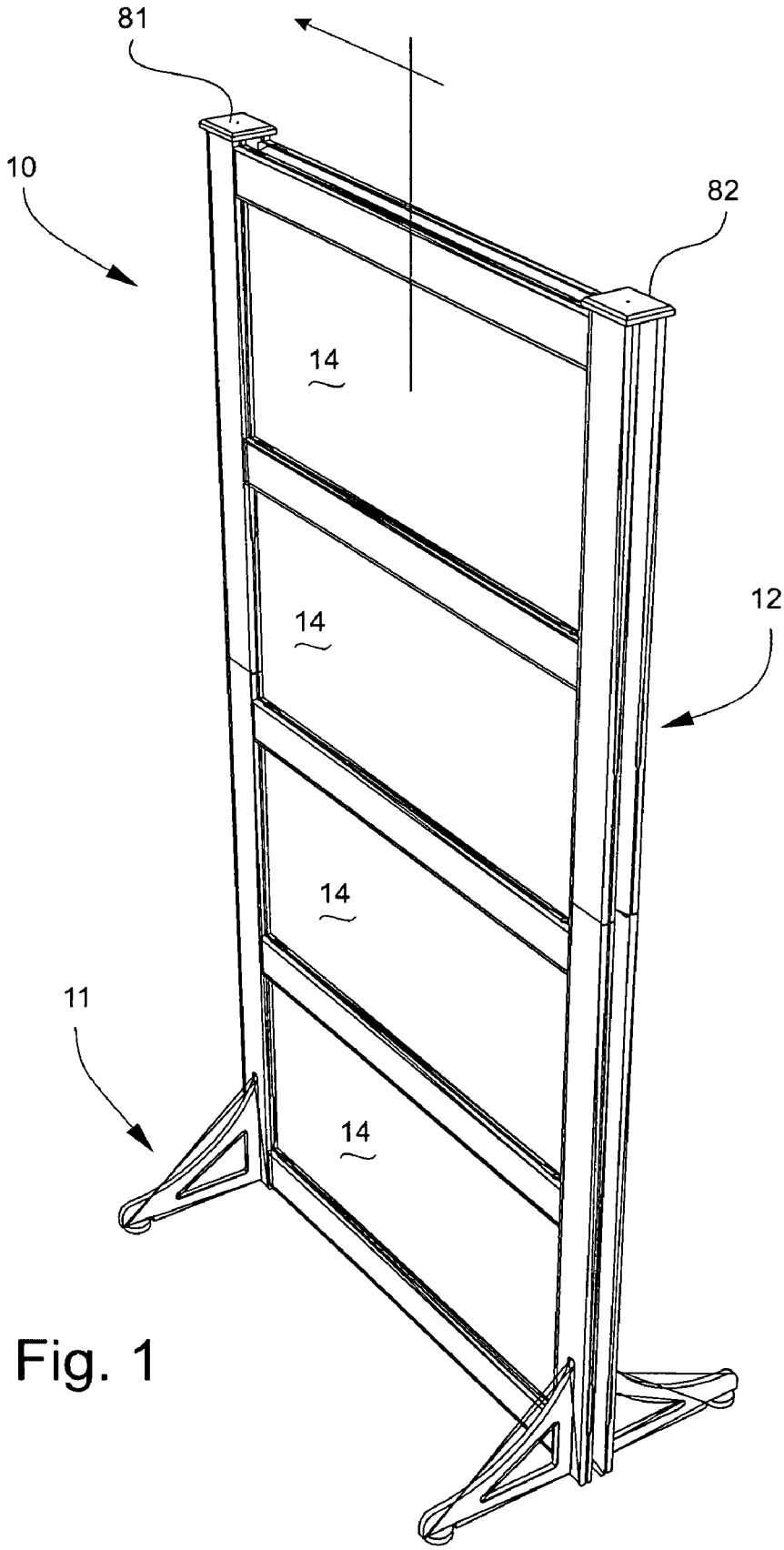
FIG. 1 is a perspective view of a modular ballistic wall assembly according to one preferred embodiment of the present invention.

Referring now specifically to the drawings, a modular ballistic wall assembly according to the present invention is illustrated in FIG. 1, and shown generally at reference numeral 10. In one preferred embodiment, the ballistic wall assembly 10 comprises a base 11, an upstanding rigid frame 12 attached to the base 11, and a number of modular ballistic wall panels 14.

Ballistic Wall Panel

Figure 2:
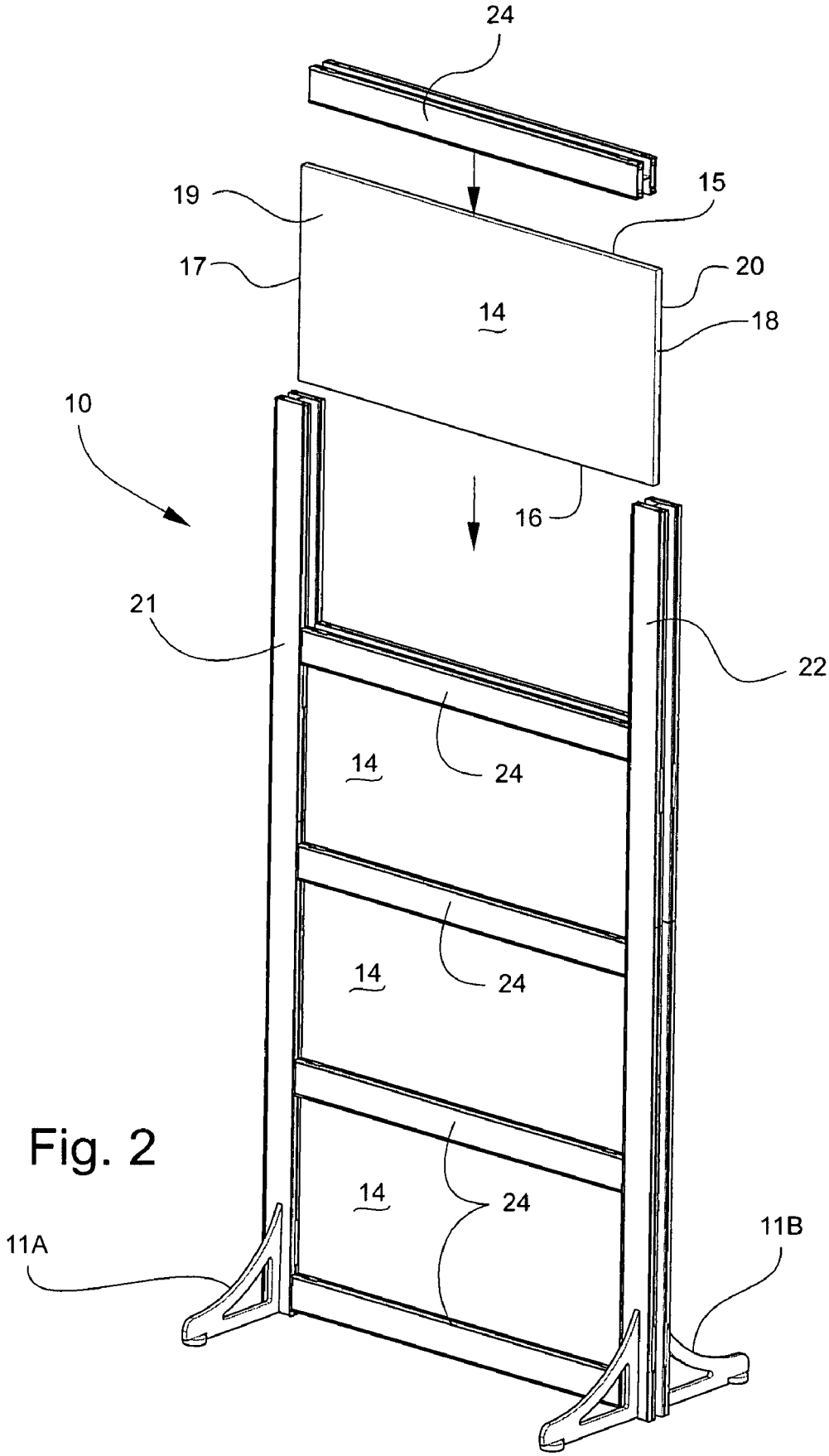
FIG. 2 is a further perspective view of the modular ballistic wall assembly with a top wall panel and cross-member exploded away from the frame.

As best illustrated in FIG. 2, each wall panel 14 comprises a substantially planar, four-sided, hard or soft armor structure having opposing top and bottom edges 15, 16, opposing side edges 17, 18, and opposing major surfaces 19, 20; the major surfaces 19, 20 defining respective threat and lee sides of the wall panel 14. In one exemplary implementation, each wall panel 14 may have a thickness of approximately 0.75 inches, a length of approximately 40 inches, a height of approximately 20 inches, and a weight of approximately 21 pounds. Such size and weight facilitate efficient transport of the wall panels 14 and subsequent construction of the ballistic wall assembly 10. It should be understood that wall panels 14 may be made in different configurations (e.g., thicknesses, weights) to provide different sizes and levels of ballistic protection (e.g., National Institute of Justice (NIJ) ballistic threat levels 3, 4 and others).

Each panel 14 may include one or more layers of woven ballistic fabric or a bi-directional composite ballistic structure. Moreover, the wall panels 14 may have been compressed during manufacture to provide more protection for a given cross-sectional width of material. Examples of possible ballistic materials include KEVLAR® brand ballistic material, SPECTRA® brand ballistic material, SPECTRA SHIELD® brand ballistic material, and other types of manufactured ballistic materials known to those skilled in the ballistic shield and armor arts.

In one implementation consistent with the principles of the invention, the wall panels 14 may be covered by a fabric (not shown) (e.g., CORDURA® brand textured nylon or a similar toughened material, possibly including a ballistic fabric) that serves as an external covering. The fabric covering may include different external colors, such as black, yellow, "camouflage" brown/green patterns, and so forth. Fabric may also be amenable to painting (or attaching hook and loop fasteners for) logos or word(s) on the front of the wall modules. A fabric covering (or portions thereof may also be relatively easily replaced in the event of damage or excessive wear. Alternatively, the panels 14 may be covered with a thin acrylic laminate sheet material.

In another implementation consistent with principles of the invention, an assembly of ceramic tiles (not shown) may be attached to a threat side 19 of one or more of the wall panels 14 to provide additional ballistic protection. In one exemplary implementation, each ceramic tile may have a size of approximately 2 inches×2 inches×0.25 inches and a weight of approximately 0.125 pounds. Even more specifically, such ceramic panels may increase the threat protection rating of the wall modules from NIJ 3 to NIJ 4.

In yet anther exemplary implementation, one or more wall panels 14 may comprise a window panel formed of a suitable transparent ballistic material, such as ballistic polycarbonate or a similar material. The window panel may be designed to provide a similar level of ballistic protection to wall panels, described above, so as to enable law enforcement personnel to view an environment on the opposite side of wall. In one exemplary implementation consistent with principles of the invention, window panels may be similarly sized to wall panels and have a weight of approximately 25 pounds, and a threat protection rating of NIJ4.

Modular Frame 12

Referring to FIGS. 1-4, the modular frame 12 of the ballistic wall assembly 10 comprises spaced vertical uprights 21, 22 and horizontal cross-members 24. In one exemplary implementation, the uprights 21, 22 and cross-members 24 may be formed of extruded aluminum, although any other suitable frame material may be used. The uprights 21, 22 are preferably attached to respective base elements 11A, 11B designed to support the frame 12. Alternatively, guy wires or other suitable support structure (not shown) may be employed. Each of the frame elements 21, 22, and 24 has a substantially H-shaped cross-section which forms adjacent and divided panel channels 25A and 25B, best shown in FIGS. 3 and 4. The panel channels 25A, 25B are designed to receive respective abutting edges of adjacent wall panels 14. The modular cross-members 24 extend laterally between the uprights 21, 22, and reside between adjacent wall panels 14 arranged edge-to-edge in the frame 12.

Figures 3, 3A:
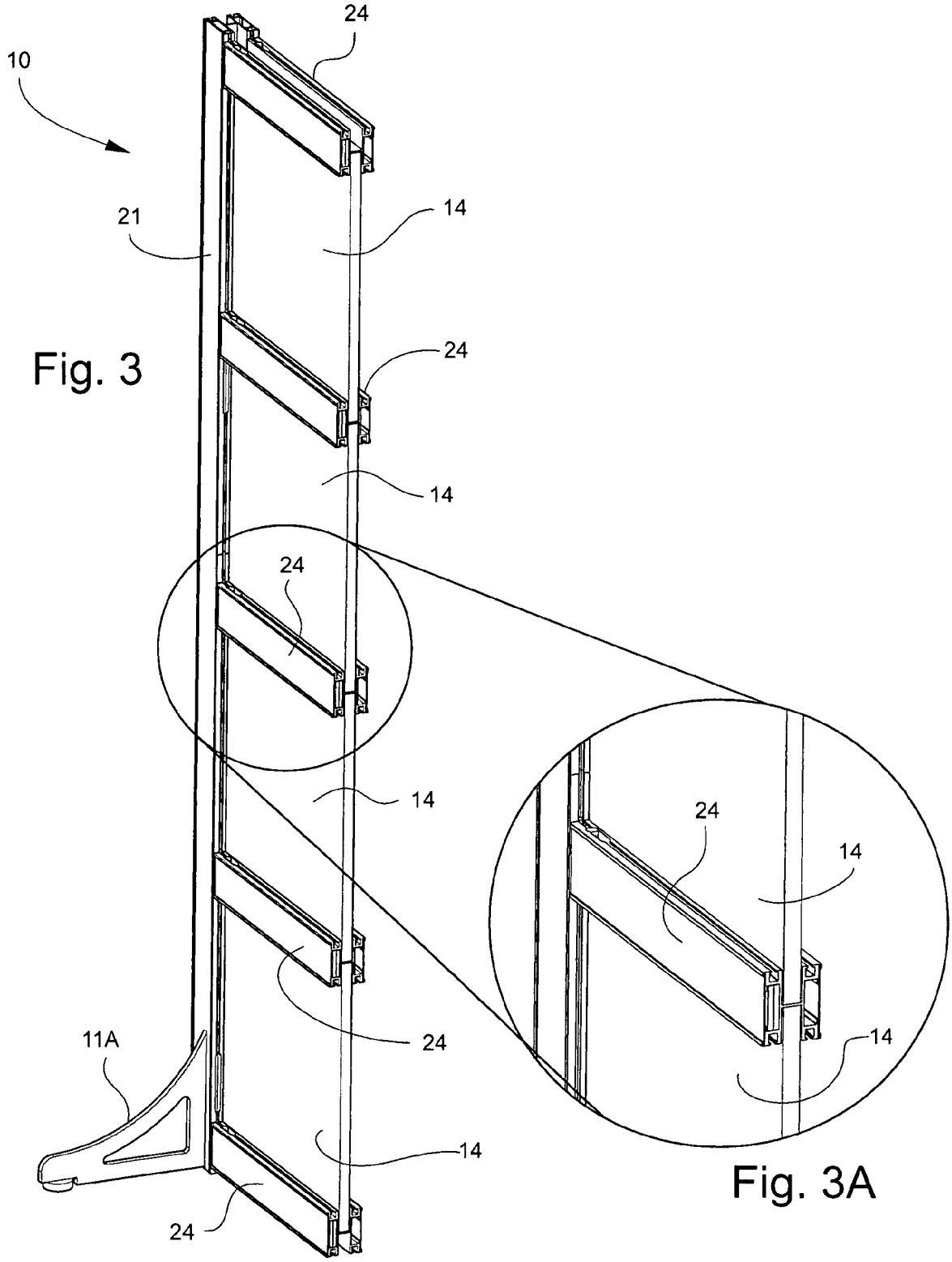
FIG. 3 is a cross-sectional view of the modular ballistic wall assembly taken substantially along line 3 in FIG. 1.
FIG. 3A is an enlarged view of a designated area of the wall assembly shown in FIG. 3.
Figure 4:
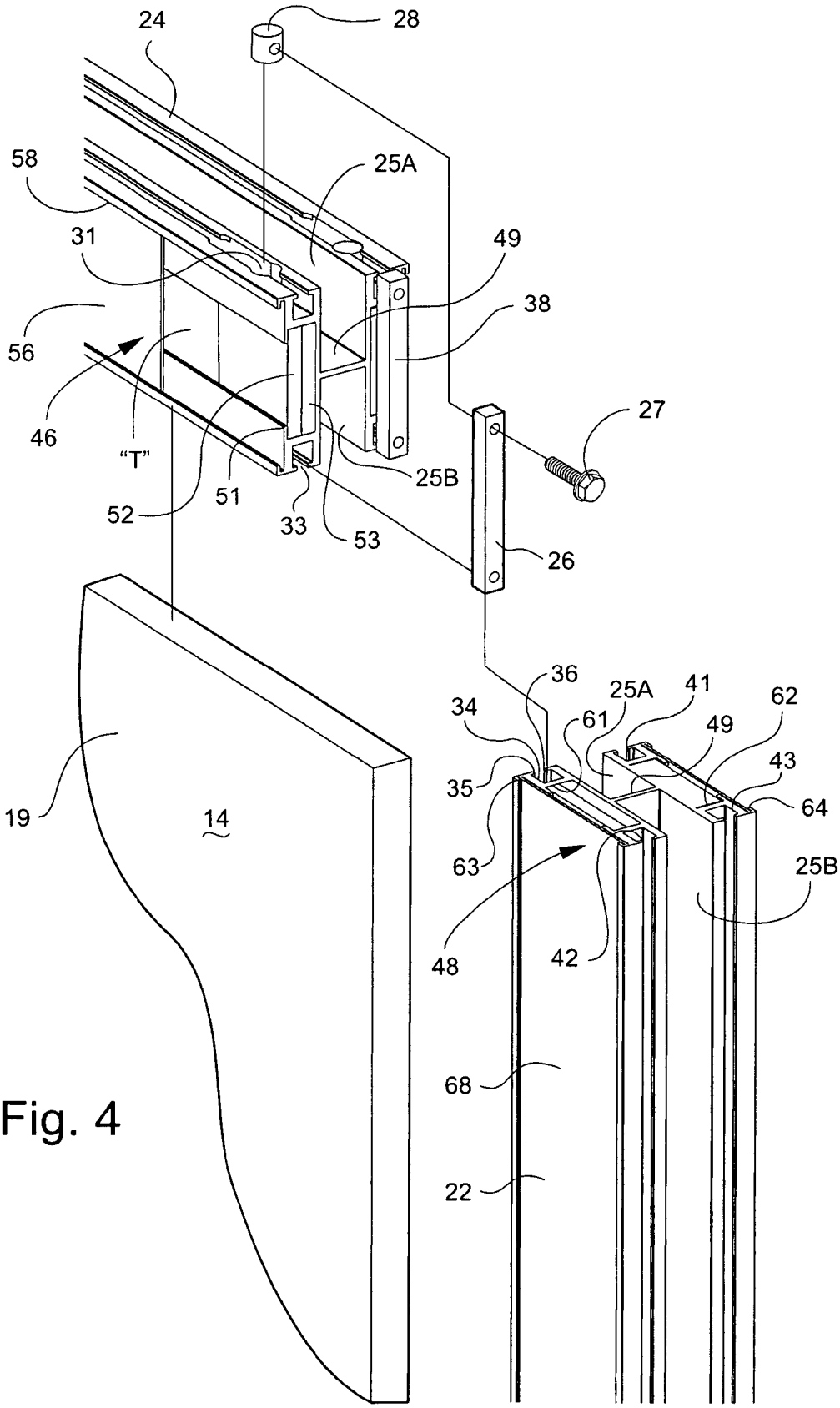
FIG. 4 is an enlarged fragmentary view of a portion of the wall assembly with various elements exploded away.

As demonstrated in FIG. 4, the cross-member 24 is attached to the upright 22 using hardware comprising an elongated fastener bar 26, threaded bolts 27, and complementary-threaded fastener barrels 28 (only one bolt and fastener barrel shown). The fastener barrel 28 resides within a longitudinal fastener track 31 formed with the cross-member 24. The threaded bolt 27 passes through an opening 32 in the fastener bar 26, and into the fastener track 31 where it mates with the complementary-threaded fastener barrel 28. A second fastener barrel (not shown) is received in the fastener track 33 and cooperates with a second bolt (not shown) to further attach the fastener bar 26 to the cross-member 24. The fastener bar 26 is then slidably received within a corresponding fastener track 34 formed with the modular upright 22. Opposing inwardly-turned flanges 35, 36 formed with the fastener track 34 engage the fastener bar 26, and prevent the cross-member 24 from inadvertently separating from the upright 22. Fastener bar 38, shown in FIG. 4, attaches in an identical manner using cooperating fastener barrels located in respective fastener channels and threaded bolts passing through openings in the fastener bar 38. The fastener bar 38 is slidable received within fastener channel 41 to further interconnect the cross-member 24 and upright 22. Likewise, the opposite end of the cross-member 24 is attached to the upright 21 in an identical manner using identical hardware. The wall assembly 10 is expandable (e.g., FIGS. 9 and 10) by attaching additional cross-members to the fastener tracks 42 and 43 of the upright 22 in an identical manner using identical hardware. The other modular cross-members 24, shown in FIG. 3, are attached at their respective opposite ends to each upright 21, 22 in an identical manner using identical hardware.

Ballistic Seam Protectors

Referring to FIGS. 4-8, for added security threat-side ballistic seam protectors 46 and 48 are located at each of the cross-members 24 and uprights 21, 22, and designed to cover unprotected seams at abutting edges of adjacent wall panels 14 carried by the frame 12. The divider 49 located between panel channels 25A, 25B of each H-shaped frame element serves to properly position the assembled wall panels 14 such that marginal portions of the panels reside substantially inside respective channels 25A, 25B. This minimizes the unprotected seam, and serves to precisely locate the seam protector 46, 48 in the wall assembly 10 at an area of otherwise compromised ballistic capabilities.

Figure 5:
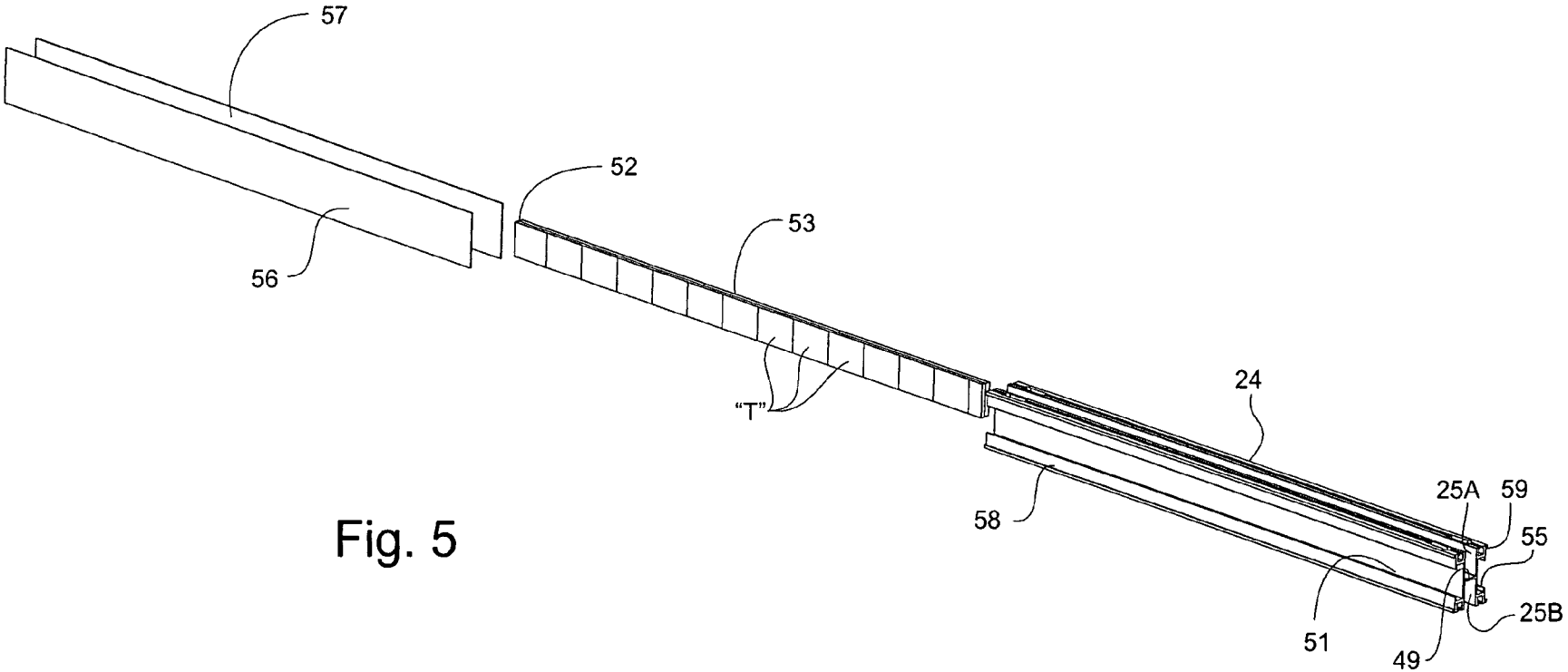
FIG. 5 is a perspective view of the frame cross-member with the offset tile assemblies of the ballistic seam protector and aesthetic covers removed from their respective tracks.

As best shown in FIGS. 4 and 5, the seam protector 46 at the cross-member 24 of the frame 12 comprises an edge-to-edge assembly of hard armor tiles "T" residing within a threat-side tile track 51 formed with the cross-member 24. The tile track 51 preferably spans the entire outside major surface of the cross-member 24, such that the hard armor tiles "T" substantially cover both of the divided panel channels 25A, 25B. In one embodiment, the seam protector 46 includes front and back rows 52, 53 of tile assemblies which are offset, such that vertical seams formed between adjacent tiles "T" of the front row 52 are offset from seams formed between adjacent tiles of the back row 53. The ballistic tiles "T" are preferably secured to each other, and to the cross-member 24 using glue or other suitable adhesive. In certain applications of the ballistic wall assembly 10, it may also be desirable to include an identical seam protector (not shown) on the lee side of the wall panels 14. In this case, offset front and back rows of ballistic tiles may be located in a lee-side tile track 55 formed with the cross-member 24.

Referring to FIG. 5, thin outside covers 56 and 57 are preferably inserted in respective threat-side and lee-side cover tracks 58 and 59 adjacent respective tile tracks 51, 55 of the cross-member 24. In one particular embodiment, each cover 56, 57 comprises a thin acrylic laminate having an aesthetic wood panel appearance or other desired look, such as camouflage.

Figure 6:
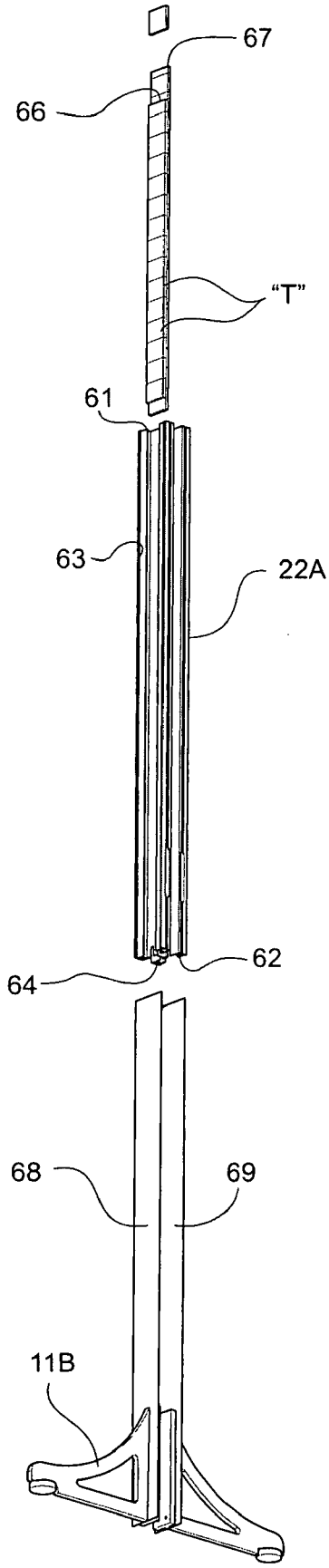
FIG. 6 is a perspective view of a lower section of the frame upright with the offset tile assemblies of the ballistic seam protector and aesthetic covers removed from their respective tracks.

Additional seam protectors 48 are located at each of the frame uprights 21, 22, as illustrated in FIGS. 4 and 6-8. The uprights 21, 22 may be formed in one or multiple sections to reach any desired height. As shown in FIG. 6, the lower section 22A attaches directly to the base element 11B, and has corresponding threat-side and lee-side tile tracks 61, 62 and cover tracks 63, 64. The threat-side tile track 61 is designed to receive first and second columnar assemblies 66, 67 of hard armor tiles "T" on the threat-side 19 of the wall panels 14. The tile assemblies 66, 67 are offset, as previously described, such that horizontal seams formed between adjacent tiles of the first columnar assembly 66 are offset from seams formed between adjacent tiles of the second columnar assembly 67. The ballistic tiles "T" are preferably secured to each other, and to the upright 22A using glue or other suitable adhesive. The cover tracks 63, 64 are designed to receive decorative outside covers 68, 69 which visually match the covers 56, 57 carried by the cross-member 24.

Figure 7:
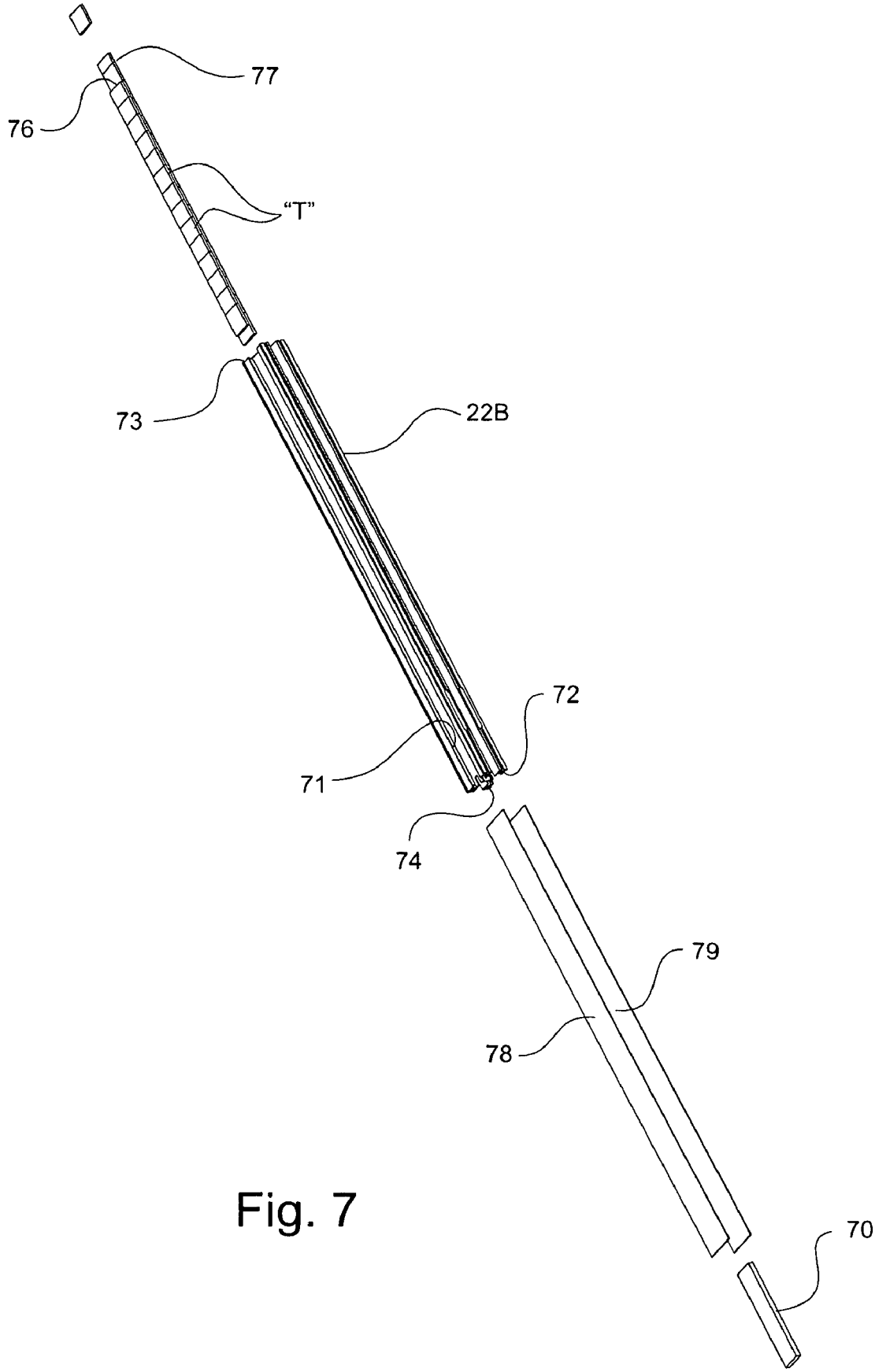
FIG. 7 is a perspective view of an upper section of the frame upright with the offset tile assemblies of the ballistic seam protector and aesthetic covers removed from their respective tracks.
Figure 8:
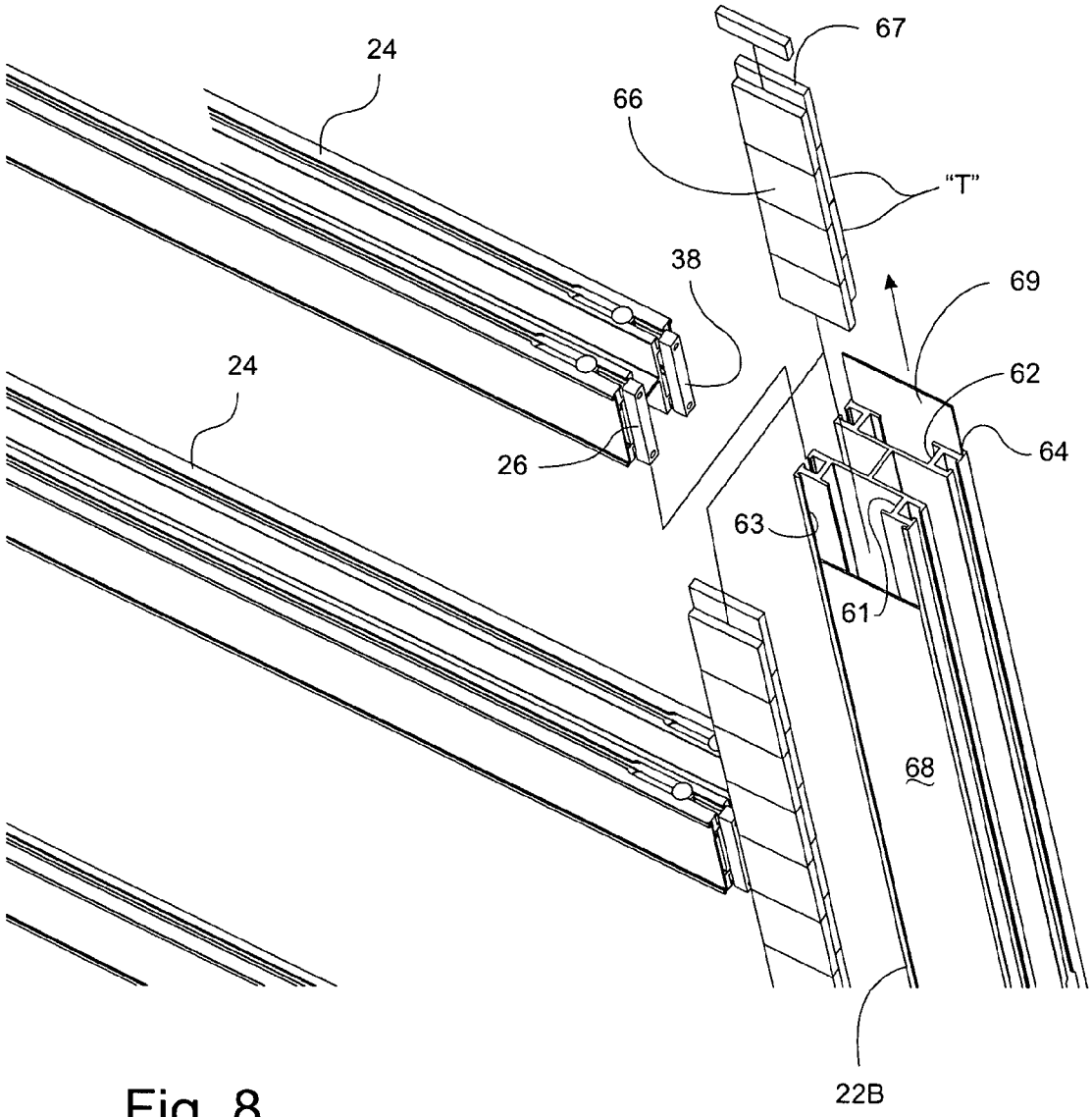
FIG. 8 is a further enlarged fragmentary view of a portion of the wall assembly with various elements exploded away.

An upper section 22B of the upright 22, shown in FIGS. 7 and 8, is attached in vertical registration to the lower section 22A using an elongated coupling 70 and suitable hardware (not shown). The upper section 22B has corresponding threat-side and lee-side tile tracks 71, 72 and cover tracks 73, 74, as previously described. The threat-side tile track 71 is designed to receive first and second columnar assemblies 76, 77 of hard armor tile "T" on the threat-side 19 of the wall panels 14. The tile assemblies 76, 77 are again offset such that horizontal seams formed between adjacent tiles of the first columnar assembly 76 are offset from seams formed between adjacent tiles of the second columnar assembly 77. The cover tracks 73, 74 receive decorative outside covers 78, 79 visually matching the covers 56, 57 and 68, 69 carried by the cross-member 24 and lower section 22A. A third seam protector (not shown) identical to that described above is carried by the upright 21. For certain applications of the ballistic wall assembly 10, it may also be desirable to include identical columnar assemblies of ballistic tiles in respective lee-side tile tracks 62, 72 formed with the upright sections 22A, 22B. Both the threat-side and lee-side tile tracks 61, 71 and 62, 72 preferably span the entire outside major surfaces of the upright sections 22A, 22B, such that the hard armor tiles "T" substantially cover both of the divided panel channels 25A, 25B. Upright 21 is preferably assembled and constructed in a manner identical to upright 22 described above. Finally, after assembly of the frame 12 and modular panels 14, decorative caps may 81 and 82 (shown in FIG. 1) may be applied to top ends of the uprights 21, 22.

Configurations

Figure 9:
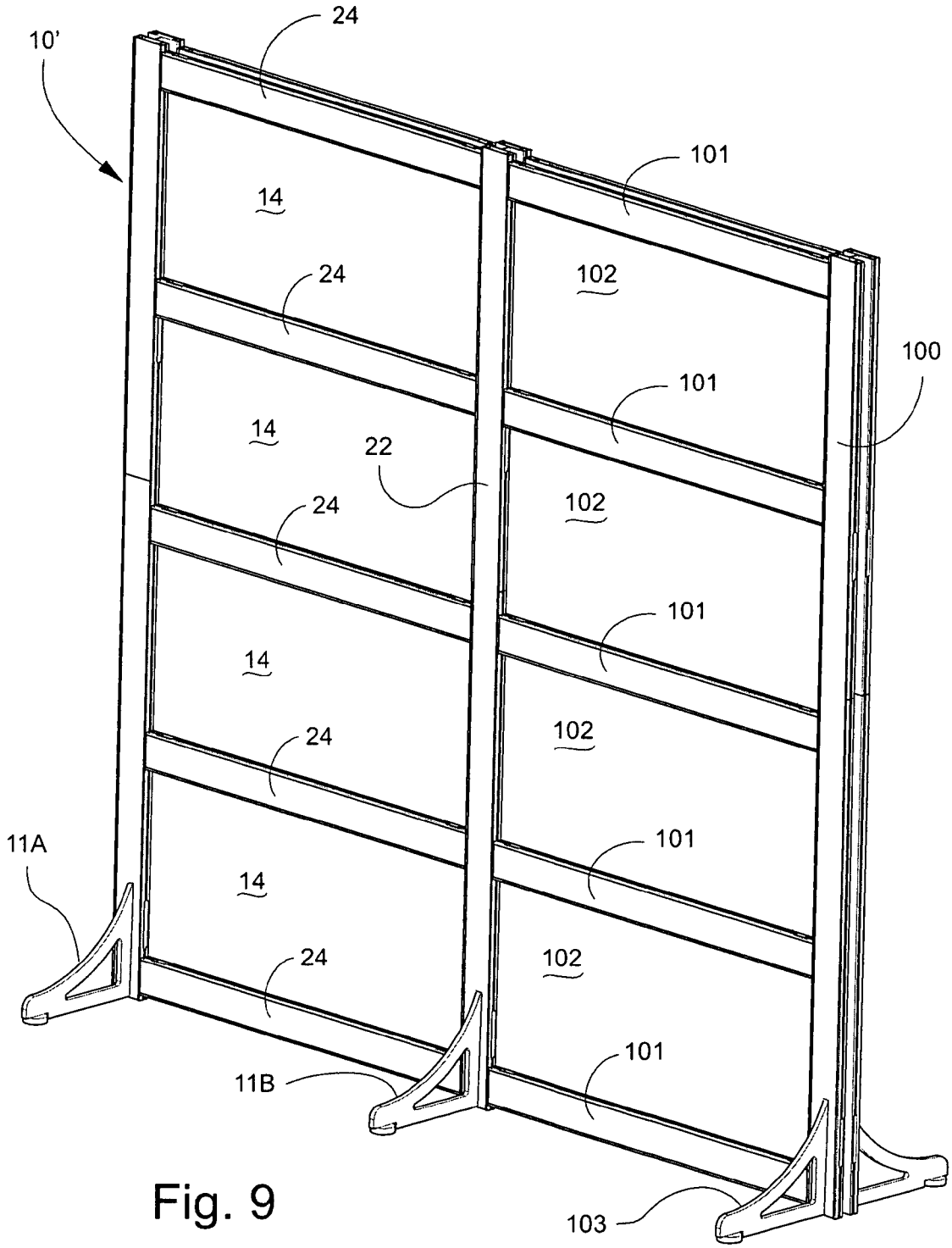
FIG. 9 is a perspective view of a modified ballistic wall assembly expanded using the various modular elements of the present invention.
Figure 10:
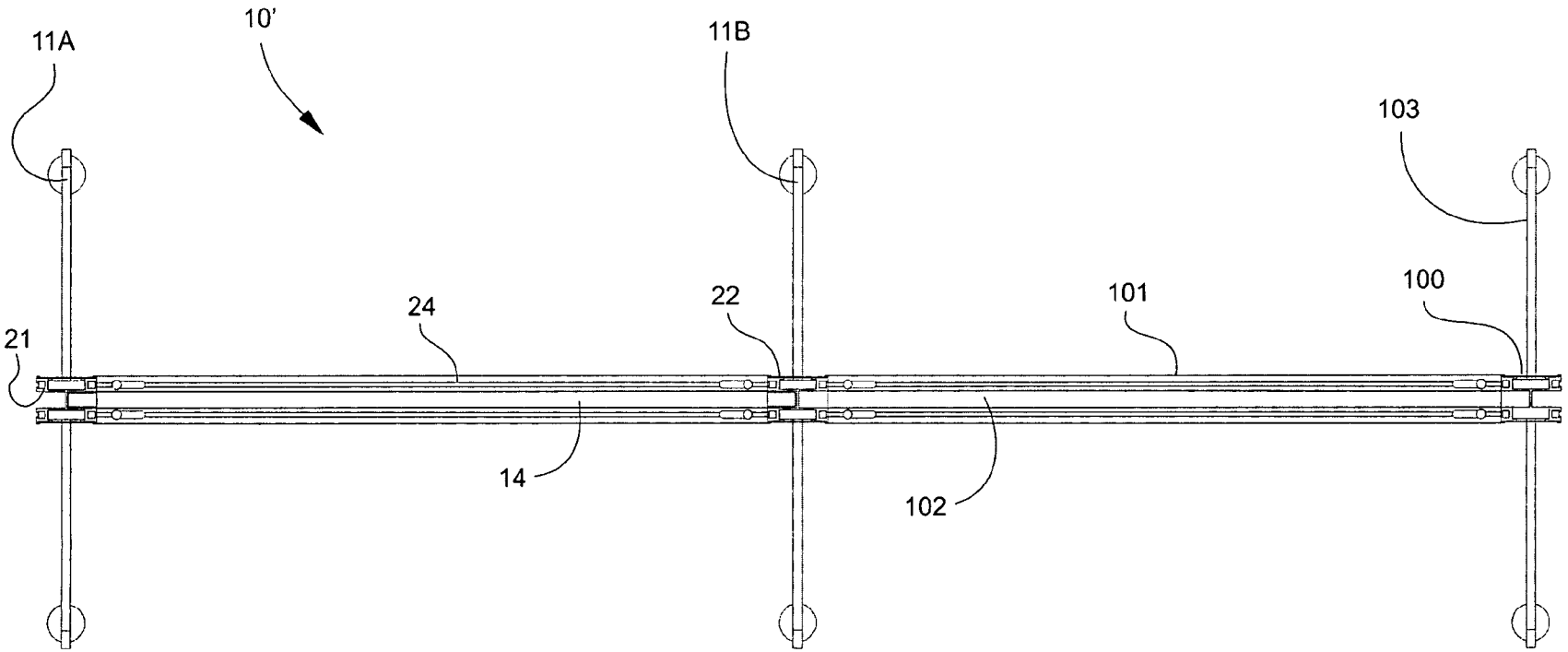
FIG. 10 is a top view of the modified ballistic wall assembly shown in FIG. 9.

Referring to FIGS. 9 and 10, the present modular wall assembly is especially applicable for ready and convenient in-the-field expansion, configurability, and re-configurability to guard against a particular threat. FIGS. 9 and 10, show the wall assembly 10' expanded with the addition of a third upright 100, cross-members 101, ballistic wall panels 102, and base element 103. The remaining elements of the wall assembly 10' including the uprights 21, 22, cross-members 24, ballistic wall elements 14, base elements 11A, 11B are identical to that previously described. The ballistic wall may be further configured, for example, to provide for a full perimeter enclosure operable to protect law enforcement personnel from all sides. In this implementation, suitable angled connecting elements may be located between adjacent uprights to form certain angles (e.g., 90 degrees) of the enclosure. Any number of other desired configurations are contemplated herein. Additionally, the wall assembly may be heightened, as desired, by the addition of one or more vertically arranged wall panels and corresponding frame elements.

To facilitate transport, disassembled elements of the modular wall assembly are preferably designed for storage in a wheeled case (not shown). The case may be sized to accommodate ballistic panels, frame elements, and hardware, as well as protective material, such as foam rubber, designed to protect the materials during transport. In this manner, multiple cases including multiple ballistic panels may be efficiently and inconspicuously moved to a desirable location for assembly.

A modular ballistic wall assembly is described above. No element, act, or instruction used in this description should be construed as critical or essential to the invention unless explicitly described as such. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims and their equivalents.

We claim:

1. A modular ballistic wall assembly, comprising:

a rigid frame including first and second spaced-apart uprights, and at least one cross-member extending between said uprights;

a plurality of ballistic panels carried by said frame between said first and second uprights, each ballistic panel comprising top and bottom edges, opposing side edges, and opposing major surfaces, said major surfaces defining respective threat and lee sides of said panel;

said ballistic panels being arranged edge-to-edge, such that adjacent panels form an unprotected seam therebetween;

a first ballistic seam protector carried by the cross-member of said frame and covering the unprotected seam on the threat-side of said ballistic panels;

a second ballistic seam protector carried by one of the first and second uprights of said frame on the threat-side of said ballistic panels, and adapted for covering a second unprotected seam formed between adjacent ballistic panels; and wherein at least one of said first and second ballistic seam protectors comprises an edge-to-edge assembly of hard armor tiles.

2. A modular ballistic wall assembly according to claim 1, wherein said first seam protector comprises an edge-to-edge assembly of hard armor tiles.

3. A modular ballistic wall assembly according to claim 2, wherein said first seam protector further comprises a second edge-to-edge assembly of hard armor tiles residing in back of said first tile assembly.

4. A modular ballistic wall assembly according to claim 3, wherein said first and second tile assemblies are offset, such that seams formed between adjacent tiles of the first assembly are offset from seams formed between adjacent tiles of the second assembly.

5. A modular ballistic wall assembly according to claim 4, wherein said hard armor tiles are constructed of a material selected from a group consisting of ceramic, steel, graphite, aluminum, and titanium.

6. A modular ballistic wall assembly according to claim 5, wherein said first seam protector further comprises an aesthetic outside cover.

7. A modular ballistic wall assembly according to claim 1, wherein said second seam protector comprises an edge-to-edge assembly of hard armor tiles.

8. A modular ballistic wall assembly according to claim 7, wherein said second seam protector further comprises a second edge-to-edge assembly of hard armor tiles residing in back of said first tile assembly.

9. A modular ballistic wall assembly according to claim 8, wherein said first and second tile assemblies are offset, such that seams formed between adjacent tiles of the first assembly are offset from seams formed between adjacent tiles of the second assembly.

10. A modular ballistic wall assembly according to claim 9, wherein said hard armor tiles are constructed of a material selected from a group consisting of ceramic, steel, graphite, aluminum, and titanium.

11. A modular ballistic wall assembly according to claim 10, wherein said second seam protector further comprises an aesthetic outside cover.

12. A modular ballistic wall assembly according to claim 1, and comprising a base attached to said rigid frame and supporting said frame in a substantially upright condition.

13. A modular ballistic wall assembly according to claim 1, wherein each ballistic panel is substantially planar, and comprises substantially straight top, bottom, and side edges.

14. A modular ballistic wall assembly according to claim 1, wherein at least one of said first and second uprights has a generally H-shaped cross-section defining first and second longitudinal panel channels adapted for receiving respective edges of adjacent ballistic panels.

15. A modular ballistic wall assembly according to claim 1, wherein said first and second uprights comprise respective longitudinal fastener tracks for securing said cross-member and first ballistic seam protector at the unprotected seam between said adjacent ballistic panels.

16. A modular ballistic wall assembly according to claim 1, wherein said cross-member has a generally H-shaped cross-section defining first and second lateral panel channels adapted for receiving respective edges of adjacent ballistic panels.

17. A modular ballistic wall assembly, comprising:

a rigid frame including first and second spaced-apart uprights, and at least one cross-member extending between said uprights;

a plurality of ballistic panels carried by said frame between said first and second uprights, each ballistic panel comprising top and bottom edges, opposing side edges, and opposing major surfaces, said major surfaces defining respective threat and lee sides of said panel;

said ballistic panels being arranged edge-to-edge, such that adjacent panels form an unprotected seam therebetween;

a first ballistic seam protector carried by the cross-member of said frame and covering the unprotected seam on the threat-side of said ballistic panels;

wherein said first and second uprights comprise respective longitudinal fastener tracks for securing said cross-member and said first ballistic seam protector at the unprotected seam between said adjacent ballistic panels;

a second ballistic seam protector carried by the first upright of said frame on the threat-side of said ballistic panels, and adapted for covering a second unprotected seam formed between adjacent ballistic panels; and a third ballistic seam protector carried the second upright of said frame on the threat-side of said ballistic panels, and adapted for covering a third unprotected seam formed between adjacent ballistic panels.

18. A modular ballistic wall assembly according to claim 17, wherein each of said first and second uprights has a generally H-shaped cross-section defining first and second longitudinal panel channels adapted for receiving respective edges of adjacent ballistic panels.

19. A modular ballistic wall assembly according to claim 17, wherein said cross-member has a generally H-shaped cross-section defining first and second lateral panel channels adapted for receiving respective edges of adjacent ballistic panels.

20. A modular ballistic wall assembly according to claim 17, and comprising a base attached to said frame and supporting said frame in a substantially upright condition.

21. A modular ballistic wall assembly, comprising:

a rigid frame including first and second spaced-apart uprights, and at least one cross-member extending between said uprights;

a plurality of ballistic panels carried by said frame between said first and second uprights, each ballistic panel comprising top and bottom edges, opposing side edges, and opposing major surfaces, said major surfaces defining respective threat and lee sides of said panel;

said ballistic panels being arranged edge-to-edge, such that adjacent panels form an unprotected seam therebetween;

a first ballistic seam protector carried by said cross-member of said frame and covering the unprotected seam on said threat-side of said ballistic panels;

said first and second uprights comprising respective longitudinal fastener tracks for securing said cross-member and said first ballistic seam protector at the unprotected seam between said adjacent ballistic panels; and a second ballistic seam protector carried by one of said first and second uprights of said frame on said threat-side of said ballistic panels, and adapted for covering a second unprotected seam formed between adjacent ballistic panels.

* * * * *